US011643615B2

(12) United States Patent
Maruyama et al.

(10) Patent No.: US 11,643,615 B2
(45) **Date of Patent: *May 9, 2023**

(54) LUBRICANT COMPOSITION

(71) Applicant: NSK LTD., Tokyo (JP)

(72) Inventors: Taisuke Maruyama, Fujisawa (JP); Yujiro Toda, Fujisawa (JP); Eri Watabe, Fujisawa (JP); Suguru Sugawara, Fujisawa (JP); Masayuki Maeda, Fujisawa (JP)

(73) Assignee: NSK LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/637,140

(22) PCT Filed: Dec. 21, 2018

(86) PCT No.: PCT/JP2018/047391

§ 371 (c)(1),
(2) Date: Feb. 6, 2020

(87) PCT Pub. No.: WO2019/131560

PCT Pub. Date: Jul. 4, 2019

(65) Prior Publication Data

US 2020/0248097 A1 Aug. 6, 2020

(30) Foreign Application Priority Data

Dec. 25, 2017 (JP) ..... JP2017-247911

(51) Int. Cl.
*C10M 169/06* (2006.01)
*C10M 107/02* (2006.01)
(Continued)

(52) U.S. Cl.
CPC ..... *C10M 169/06* (2013.01); *C10M 107/02* (2013.01); *C10M 115/08* (2013.01);
(Continued)

(58) Field of Classification Search
CPC .... C10M 2207/1206; C10M 2219/068; C10M 2223/041; C10M 2223/049; C10N 2010/00; C10N 2040/02; C10N 2050/10
See application file for complete search history.

(56) References Cited

U.S. PATENT DOCUMENTS 6,268,316 B1 * 7/2001 Tanaka ..... C10M 163/00 508/291
8,673,830 B2 3/2014 Fujinami et al.
2006/0154833 A1 7/2006 Katou et al.
(Continued)

FOREIGN PATENT DOCUMENTS

CN 1641004 A 7/2005
CN 105745313 A 7/2016
(Continued)

OTHER PUBLICATIONS

Communication dated Jan. 7, 2020 issued by the Japanese Patent Office in counterpart Japanese Application No. 2019-560417.
(Continued)

*Primary Examiner* — Vishal V Vasisth
(74) *Attorney, Agent, or Firm* — Sughrue Mion, PLLC

(57) ABSTRACT

A lubricant composition according to the present invention contains a fatty acid metal salt, a metal dithiocarbamate, and an additive having an effect of increasing an acid value of the lubricant composition, whereby fretting resistance performances are further improved.

10 Claims, 5 Drawing Sheets

(51) Int. Cl.

| | |
|---|---|
| ***C10M 115/08*** | (2006.01) |
| ***C10M 129/40*** | (2006.01) |
| ***C10M 137/04*** | (2006.01) |
| ***C10M 139/00*** | (2006.01) |
| ***C10M 141/12*** | (2006.01) |
| *C10N 40/02* | (2006.01) |

(52) U.S. Cl.

CPC ..... *C10M 129/40* (2013.01); *C10M 137/04* (2013.01); *C10M 139/00* (2013.01); *C10M 141/12* (2013.01); *C10M 2205/0206* (2013.01); *C10M 2207/126* (2013.01); *C10M 2215/1026* (2013.01); *C10M 2219/068* (2013.01); *C10M 2223/04* (2013.01); *C10M 2290/04* (2013.01); *C10M 2290/10* (2013.01); *C10N 2040/02* (2013.01)

(56) References Cited

U.S. PATENT DOCUMENTS

| | | | | |
|---|---|---|---|---|
| 2008/0196995 | A1 | 8/2008 | Mikami et al. | |
| 2008/0271967 | A1* | 11/2008 | Nakatani ..... | F16C 33/6633 192/45.006 |
| 2011/0021394 | A1 | 1/2011 | Nakao et al. | |
| 2014/0249060 | A1 | 9/2014 | Nakao et al. | |
| 2016/0289589 | A1 | 10/2016 | Moriizumi et al. | |
| 2017/0253826 | A1* | 9/2017 | Suetsugu ..... | C10M 115/08 |

FOREIGN PATENT DOCUMENTS

| | | | | |
|---|---|---|---|---|
| JP | 2003-113845 | A | | 4/2003 |
| JP | 2003-327990 | A | | 11/2003 |
| JP | 2005-188726 | A | | 7/2005 |
| JP | 2005-194303 | A | | 7/2005 |
| JP | 2006-169386 | A | | 6/2006 |
| JP | 2006200561 | A | * | 8/2006 |
| JP | 2007-023105 | A | | 2/2007 |
| JP | 2017-19987 | A | | 1/2017 |
| KR | 1020100125289 | A | | 11/2010 |

OTHER PUBLICATIONS

International Search Report (PCT/ISA/210) dated Mar. 19, 2019 issued by the International Searching Authority in International Application No. PCT/JP2018/047391.

Written Opinion (PCT/ISA/237) dated Mar. 19, 2019 issued by the International Searching Authority in International Application No. PCT/JP2018/047391.

Search Report dated Jan. 29, 2021 by the European Patent Office in counterpart European Patent Application No. 18895842.5.

Communication dated Aug. 23, 2021 issued by the State Intellectual Property Office of the P.R. China in application No. 201880058788.8.

* cited by examiner

LUBRICANT COMPOSITION

This application is a 371 of PCT/JP2018/047391 filed Dec. 21, 2018.

TECHNICAL FIELD

The present invention relates to a lubricant composition containing a particular additive and particularly, to a lubricant composition suitable for a rolling bearing.

BACKGROUND ART

When a rolling bearing for supporting a support shaft, such as a bearing for an AC servo motor, a hub bearing, and a pivot bearing for a hard disk drive (HDD), performs a slight reciprocation, or when it undergoes a slight reciprocation, fretting occurs on a surface of rolling element or a raceway surface of the bearing, and various problems occur, such as an increase in bearing torque, and flaking starting from a damaged part.

For a countermeasure against fretting wear, for example, ceramic balls have been used for rolling elements as described in Patent Document 1. However, ceramic balls cost higher as compared with commonly used steel balls.

Thus, fretting resistance has been also enhanced by a lubricant composition used for lubrication. For example, Patent Document 2 describes a grease composition to which inorganic magnesium fine particles and magnesium stearate are added. In addition, Patent Document 3 describes a grease composition to which one or more kinds selected from the group consisting of aluminum salts, magnesium salts, zinc salts and calcium salts of fatty acids are added.

RELATED ART

Patent Document

Patent Document 1: JP-A-2005-188726
Patent Document 2: JP-A-2007-023105
Patent Document 3: JP-A-2006-169386

SUMMARY OF INVENTION

Problem that Invention is to Solve

However, there is a great demand for further improvement in fretting resistance. An object of the present invention is to provide a lubricant composition with further improved fretting resistance performances.

Means for Solving the Problems

In order to solve the above problems, the present inventors have found that the fretting resistance is greatly improved due to a combined use of a fatty acid metal salt, a metal dithiocarbamate, and an additive (acid value improver) having an effect of increasing an acid value of a lubricant composition, and found that there are relationships between a blending ratio of the fatty acid metal salt and the metal dithiocarbamate and a blending ratio of the fatty acid metal salt and the total acid value of the lubricant composition or the acid value improver, and optimization of these relationships greatly improves the fretting resistance. Accordingly, they have accomplished the present invention. That is, the present invention provides the following lubricant composition.

(1) A lubricant composition comprising, a fatty acid metal salt, a metal dithiocarbamate and an additive having an effect of increasing an acid value of the lubricant composition.

(2) The lubricant composition according to (1), wherein when a ratio of [content of the fatty acid metal salt (mass %)/content of the metal dithiocarbamate (mass %)] is defined as X, and a ratio of [content of the fatty acid metal salt (mass %)/total acid value of the lubricant composition (mgKOH/g)] is defined as Y, X is 0.38 to 1.35, Y is 0.027 or more, and the following relationship (A) is satisfied, $$Y \leq 0.1547X^2 - 0.1388X + 0.07 \quad \text{(A)}.$$

Effects of the Invention

In the lubricant composition according to the present invention, in addition to the effect of improving fretting resistance by the fatty acid metal salt and the metal dithiocarbamate, the total acid value of the lubricant composition is increased to a certain value or more by the acid value improver, so that the fatty acid metal salt is dissolved in the base oil of the lubricant composition to further improve the fretting resistance. For that reason, the application of the lubricant composition eliminates the need for use of an expensive ceramic ball for rolling elements and provides a long-life rolling bearing which is inexpensive and has excellent fretting resistance.

EMBODIMENTS FOR CARRYING OUT THE INVENTION

Figure 1:
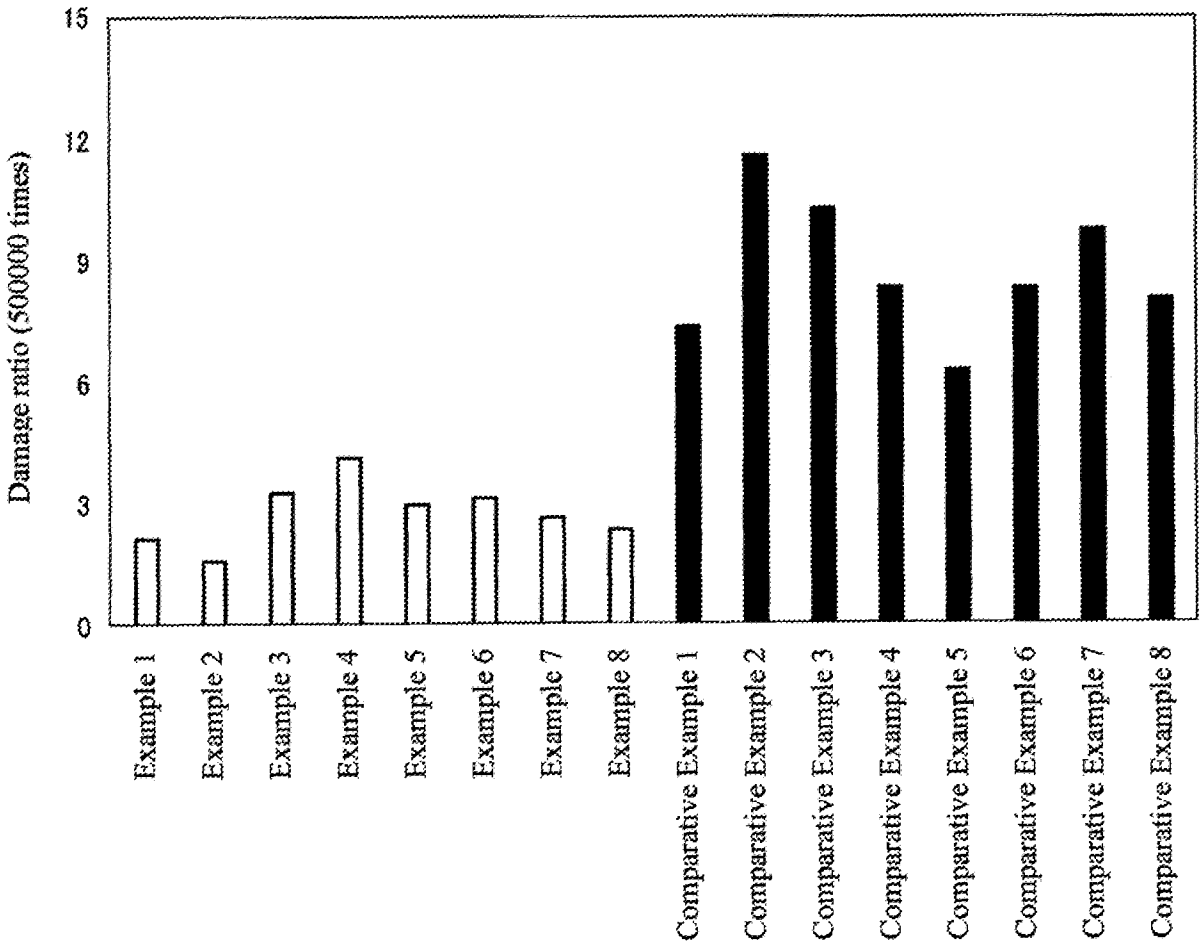
FIG. 1 It is a graph showing each damage ratio of Examples and Comparative Examples.

Hereinafter, the present invention will be described in detail.

Lubricant Composition

A lubricant composition according to the present invention contains a fatty acid metal salt, a metal dithiocarbamate, and an acid value improver for increasing an acid value of a lubricant composition. The form thereof is not limited and may be a lubricating oil composition obtained by adding three kinds of additives to lubricating oil, or may be a grease composition obtained by adding the three kinds of additives to a base grease containing a base oil and a thickener.

The lubricating oil and the base oil of the grease composition are not limited, and mineral oils or synthetic oils can be used therefor. Examples of mineral oils include paraffinic mineral oils and naphthenic mineral oils. In particular, those purified by appropriately combining vacuum distillation, oil deasphalting, solvent extraction, hydrocracking, solvent dewaxing, washing with sulfuric acid, purification with white clay, hydrorefining and the like are preferred. Examples of synthetic oils include hydrocarbon oils, aromatic oils, ester oils, and ether oils. Examples of hydrocarbon oils include poly α-olefin such as normal paraffin, isoparaffin, polybutene, polyisobutylene, 1-decene oligomer, and oligomers of 1-decene and ethylene, or hydrides thereof. Examples of aromatic oils include alkylbenzene such as monoalkylbenzene and dialkylbenzene, and alkylnaphthalene such as monoalkylnaphthalene and dialkylnaphthalene. Examples of ester oils include diester oils such as dibutyl sebacate, di-2-ethylhexyl sebacate, dioctyl adipate, diisodecyl adipate, ditridecyl adipate, ditridecyl glutarate, and methyl acetyl cinolate, aromatic ester oils such as trioctyl trimellitate, tridecyl trimellitate, and tetraoctyl pyromellitate, polyol ester oils such as trimethylolpropane caprylate, trimethylolpropane pelargonate, pentaerythritol-2-ethylhexanoate, pentaerythritol belargonate, and complex ester oils that are oligoesters of polyhydric alcohols and mixed fatty acids of dibasic and monobasic acids. Examples of ether oils include polyglycol such as polyethylene glycol, polypropylene glycol, polyethylene glycol monoether, and polypropylene glycol monoether, phenyl ether oils such as monoalkyltriphenyl ether, alkyl diphenyl ether, dialkyl diphenyl ether, pentaphenyl ether, tetraphenyl ether, monoalkyl tetraphenyl ether, and dialkyl tetraphenyl ether. These may be used alone, or two or more thereof may be mixed and used.

Among them, the synthetic oils are preferred, and poly α-olefin (PAO) and ester oils are more preferred. In addition, PAO is preferred for placing importance on wear resistance such as fretting resistance.

In addition, in consideration of fluidity at from a low temperature to a high temperature, a kinematic viscosity of the above oil is preferably 5 to 400 $mm^2/s$ and more preferably 10 to 100 $mm^2/s$ at a temperature of 40° C. When two or more kinds of oils are mixed and used, the kinematic viscosity is adjusted thereto.

For the grease composition, a urea compound or a metal soap is used as the thickener. Examples of the urea compound include an aliphatic urea compound, an alicyclic urea compound, and an aromatic urea compound, any of which is not limited and may be diurea, triurea, tetraurea and polyurea. Examples of the metal soap include metal soaps or composite metal soaps whose metallic species are Li, Na, Ba, Ca, and the like. In addition, the amount of thickener is not limited as long as the base oil can be kept in a gel form, and is preferably 5 to 50 mass % relative to the total amount of the base oil and the thickener. If the amount of the thickener is less than 5 mass %, the grease composition leaks, which is not preferred. If the amount of the thickener is more than 50 mass %, another problem is likely to occur, such as poor pumpability of the grease composition. Particularly, a product, which is obtained by allowing cyclohexylamine and stearylamine in a molar ratio of 7:3 to react with diphenylmethane diisocyanate (MDI), is preferred.

In addition, worked penetration of the grease composition is preferably 150 to 400. If the worked penetration is more than 400, the grease composition is scattered by centrifugal force to contaminate the outside, and if the worked penetration is less than 150, the pumpability of the grease composition becomes poor.

Fatty Acid Metal Salt

Preferred examples of fatty acid metal salts include metal salts that are formed of saturated or unsaturated fatty acids or hydroxy fatty acids having 4 to 18 carbon atoms and metal selected from the group consisting of aluminum, magnesium, silver, cadmium, copper, iron, nickel, barium, lithium, potassium, sodium, zinc, and calcium. Examples of fatty acids include linear saturated acids such as caproic acid, caprylic acid, capric acid, lauric acid, myristic acid, palmitic acid, stearic acid and 12-hydroxystearic acid, and branched saturated acids such as 4,6-dimethyloctanoic acid, 2-methylundecanoic acid, 2-methyltetradecanoic acid and 2-ethylpentadecanoic acid. Examples of unsaturated acids include 3-octenoic acid, 2-decenoic acid, caproleic acid, myristoleic acid, 2-methyl-2-dodecenoic acid, oleic acid, elaidic acid, linoleic acid, linolenic acid, and ricinoleic acid. These fatty acid metal salts may be used alone, or two or more thereof may be mixed and used. In particular, it is particularly preferred to mix and add four kinds of copper salts, iron salts, zinc salts, and magnesium salts of stearic acid.

A content of the fatty acid metal salts is preferably 0.001 to 15 mass %, and more preferably 0.001 to 10 mass % of the total amount of the lubricant composition. The content of less than 0.001 mass % cannot provide the effect of improving fretting resistance sufficiently. The effect is only saturated with the content of more than 15 mass %.

Metal Dithiocarbamate

As a metal dithiocarbamate, for example, a compound represented by the following general formula (I) is preferred.

[Chem 1]

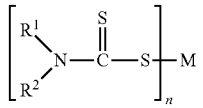

(I)

In the formula, M represents metal, and examples of M include aluminum, magnesium, copper, iron, nickel, barium, lithium, potassium, sodium, zinc, and molybdenum, in which zinc is particularly preferred. n is an integer corresponding to the valence of the metal. $R^1$ and $R^2$ represent a primary alkyl group, a secondary alkyl group, and an aryl group or an alkylaryl group, which have 2 to 18 carbon atoms, and $R^1$ and $R^2$ may be the same or different from each other. These metal dithiocarbamate may be used alone, or may be used by mixing a plurality thereof.

It is considered that when the lubricant composition is a grease composition, the metal dithiocarbamate contributes to improving the fretting resistance by strengthening a thickener.

A content of the metal dithiocarbamate is preferably 0.001 to 15 mass %, and more preferably 0.001 to 10 mass % of the total amount of the lubricant composition. The content of less than 0.001 mass % cannot provide the effect of improving fretting resistance sufficiently. In addition, the effect is only saturated with the content of more than 15 mass %.

Acid Value Improver

The lubricant composition preferably has a total acid value higher than a certain value. Particularly, it contains dithiocarbamic acid and has a total acid value of 3.7 (mgKOH/g) or more, the fatty acid metal salts are completely dissolved in the base oil of the lubricant composition. When the total acid value of the lubricant composition is low, the fatty acid metal salt is dispersed in a powder (solid) state without dissolving in the base oil. Further, the powder functions as foreign matter in a contact area, which causes abrasive wear and fretting wear.

Therefore, an additive (acid value improver) having an effect of increasing the total acid value of the lubricant composition is further added. The small amount of the acid value improver causes the small increase in the total acid value of the lubricant composition to fail to sufficiently provide the effect of further improving the fretting resistance. The higher content of acid value improver allows for the higher total acid value of the lubricant composition. The content of 1 mass % or more provides a further effect of improving the fretting resistance, and particularly, the content of 2 mass % or more allows the total acid value to be 3.7 (mgKOH/g) or more at which the fatty acid metal salts are fully dissolved in the base oil. That is, the content of the acid value improver is 1 mass % or more, and preferably 2 mass % or more.

Considering stability, lubrication performance and the like when the phosphorus-type additive is added to the lubricant composition, the acid value improver is preferably phosphate esters and phosphite esters, and the following examples thereof may be used alone, or two or more thereof may be mixed and used.

Examples of phosphate esters include alkyl (C12, C14, C16, C18) acid phosphate, isotridecyl acid phosphate, oleic acid phosphate, tetracosyl acid phosphate, ethylene glycol acid phosphate, 2-hydroxymethyl methacrylate acid phosphate, dibutyl phosphate, bis(2-ethylhexyl) phosphate, diethyl benzyl phosphate, triphenylphosphine, monoethyl phosphate, mono n-butyl phosphate, mono n-octyl phosphate, mono n-lauryl phosphate and mono (2-hydroxyethyl methacrylate) phosphate, and particularly isotridecyl acid phosphate and mono n-butyl phosphate are preferred.

Examples of the phosphite esters include triphenyl phosphite, trisnonyl phenyl phosphite, tricresyl phosphite, triethyl phosphite, tris(2-ethylhexyl) phosphite, tridecyl phosphite, trilauryl phosphite, tris(tridecyl) phosphite, trioleyl phosphite, diphenyl mono(2-ethylhexyl) phosphite, diphenyl monodecyl phosphite, diphenyl mono(tridecyl) phosphite, trilauryl trithiophosphite, diethyl halogen phosphite, bis(2-ethylhexyl) hydrogen phosphite, dilauryl hydrogen phosphite, dioleyl hydrogen phosphite, diphenyl hydrogen phosphite, tetraphenyldipropylene glycol phosphite, a mixture of tetraphenyl (tetratridecyl) pentaerythritol tetraphosphite and bis(2-ethylhexyl) phthalate, tetra(C12-C15 alkyl)-4,4'-isopropylidene diphenyl phosphite, a mixture of bis (tridecyl) pentaerythritol diphosphite and bis(nonylphenyl) pentaerythritol diphosphite, bis(decyl) pentaerythritol diphosphite, bis(tridecyl) pentaerythritol diphosphite, tristearyl phosphite, distearyl pentaerythritol diphosphite, tris(2,4-di-tert-butylphenyl) phosphite, hydrogenated bisphenol A-pentaerythritol phosphite polymer and hydrogenated bisphenol A phosphite.

The total acid value of the lubricant composition can be measured, by a potentiometric titration method, based on JIS K 2501:2003 with a neutralization point pH being 12.

Other Additives

To further improve various performances, various additives may be added to the lubricant composition. For example, antioxidants such as amine antioxidants, phenolic antioxidants and sulfur antioxidants, rust preventives, oil improvers, and metal deactivators may be added alone or in appropriate combination. The addition amount of these additives is not limited to particular one as long as the object of the present invention is not impaired.

The lubricant composition according to the present invention can be used for various applications and is effective in improving fretting resistance. For example, it is effective to apply to a rolling bearing. For a lubrication method for the rolling bearing, the lubricant composition may be supplied to the rolling bearing continuously or intermittently from the outside, or may be used by having it sealed in the rolling bearing. The above lubricant composition provides the long-life rolling bearing with excellent fretting resistance performances.

In addition, an inner ring, an outer ring, and a rolling element of the rolling bearing can be formed of metal such as a bearing steel. Although a ceramic ball is conventionally used as a rolling element as a countermeasure against fretting, the ceramic ball is expensive. Hence, making the rolling element formed of metal provides an inexpensive rolling bearing.

The type of rolling bearing is not limited, and can be applied to a roller bearing with a cage, a full rolling bearing, a full complement roller bearing, and the like. In addition, the raceway surface may be a single row or a double row.

EXAMPLES

Hereinafter, the present invention will be further described with reference to Examples and Comparative Examples, but the present invention is not limited.

As shown in Table 1, copper stearate, iron stearate, zinc stearate, magnesium stearate as fatty acid metal salts, ZnDTC as metal dithiocarbamate and isotridecyl acid phosphate as an acid value improver were added to a base grease containing poly α-olefin oil (PAO: kinematic viscosity at 40° C. was 48 $mm^2/s$) as a base oil and a urea compound as a thickener, to prepare each test grease. The worked penetration of all the test greases was adjusted to 240. The urea compound is a product obtained by adding cyclohexylamine and stearylamine in a molar ratio of 7:3 (cyclohexylamine to stearylamine) to diphenylmethane diisocyanate (MDI), and allowing them to react.

In addition, the total acid value of the test grease was measured according to JIS K 2501:2003 (neutralization point pH: 12).

A fretting test was performed in which the above test grease was sealed in a single-direction thrust ball bearing having an inner diameter of 25 mm, an outer diameter of 52 mm, and a height of 18 mm (brand number: 51305), and an amplitude ratio (=amplitude/contact circle diameter) was set to 2.0. In order to measure the maximum height Ry of a damaged part accurately, the fretting test was performed under the following conditions using a disc test piece obtained by applying a wrapping to a lower race, and using a fretting tester manufactured by Nippon Seiko Co., Ltd. That is, a ball of the thrust ball bearing and an upper race were placed on the disc test piece that is a lower race, and, in a state where 1 g of test grease was sealed, the upper race was slightly oscillated with a load from the disc test piece side applied. Further, the maximum height Ry of a damage mark on the disc test piece after the test was measured using an interference microscope, and the degree of damage was evaluated by a damage ratio (=Ry after test/Ry before test). The damage ratio closer to 1 equates with less damage.

Test Condition

Maximum surface pressure: 3.2 GPa
Maximum swing speed: 20 mm/s
Number of swings: 500,000
Amplitude ratio: 2.0

TABLE 1

| | | | Example 1 | Example 2 | Example 3 | Example 4 | Example 5 | Example 6 | Example 7 | Example 8 |
|---|---|---|---|---|---|---|---|---|---|---|
| Base oil | | Amount of base oil (mass %) | 82.625 | 81.625 | 82.100 | 82.450 | 83.725 | 82.695 | 82.660 | 82.575 |
| | | Kind of base oil | PAO | PAO | PAO | PAO | PAO | PAO | PAO | PAO |
| | | Kinematic viscosity ($mm^2/s$ @ 40° C.) | 48 | 48 | 48 | 48 | 48 | 48 | 48 | 48 |
| Thickener | | Amount of thickener (mass %) | 15 | 15 | 15 | 15 | 15 | 15 | 15 | 15 |
| | | Kind of thickener | Urea | Urea | Urea | Urea | Urea | Urea | Urea | Urea |
| Additive | Fatty acid metal salt | Copper stearate (mass %) | 0.015 | 0.015 | — | 0.030 | 0.015 | 0.015 | 0.015 | 0.015 |
| | | Iron stearate (mass %) | 0.030 | 0.030 | 0.500 | 0.060 | 0.030 | 0.030 | 0.030 | 0.030 |
| | | Zinc stearate (mass %) | 0.030 | 0.030 | — | 0.060 | 0.030 | 0.030 | 0.030 | 0.030 |
| | | Magnesium stearate (mass %) | 0.100 | 0.100 | — | — | — | 0.100 | 0.100 | 0.100 |
| | Metal dithiocarbamate | ZnDTC (mass %) | 0.200 | 0.200 | 0.400 | 0.400 | 0.200 | 0.130 | 0.165 | 0.250 |
| | Acid value improver | Isotridecyl acid phosphate (mass %) | 2 | 3 | 2 | 2 | 1 | 2 | 2 | 2 |
| Total acid value (mgKOH/g) | | | 3.7 | 6.5 | 3.7 | 3.7 | 2.0 | 3.7 | 3.7 | 3.7 |
| Metal stearate/ZnDTC | | | 0.88 | 0.88 | 1.25 | 0.375 | 0.375 | 1.35 | 1.06 | 0.70 |
| Metal stearate/isotridecyl acid phosphate | | | 0.09 | 0.06 | 0.25 | 0.08 | 0.08 | 0.09 | 0.09 | 0.09 |
| Metal stearate/total acid value | | | 0.047 | 0.027 | 0.135 | 0.041 | 0.038 | 0.047 | 0.047 | 0.047 |
| Damage ratio (500,000) | | | 2.1 | 1.6 | 3.2 | 4.1 | 2.9 | 3.1 | 2.7 | 2.3 |

| | | | Comparative example 1 | Comparative example 2 | Comparative example 3 | Comparative example 4 | Comparative example 5 | Comparative example 6 | Comparative example 7 | Comparative example 8 |
|---|---|---|---|---|---|---|---|---|---|---|
| Base oil | | Amount of base oil (mass %) | 85.000 | 83.000 | 82.900 | 82.910 | 83.525 | 82.525 | 82.525 | 83.625 |
| | | Kind of base oil | PAO | PAO | PAO | PAO | PAO | PAO | PAO | PAO |
| | | Kinematic viscosity ($mm^2/s$ @ 40° C.) | 48 | 48 | 48 | 48 | 48 | 48 | 48 | 48 |
| Thickener | | Amount of thickener (mass %) | 15 | 15 | 15 | 15 | 15 | 15 | 15 | 15 |
| | | Kind of thickener | Urea | Urea | Urea | Urea | Urea | Urea | Urea | Urea |
| Additive | Fatty acid metal | Copper stearate (mass %) | — | — | — | 0.030 | 0.015 | 0.015 | 0.015 | 0.015 |
| | | Iron stearate (mass %) | — | — | — | — | 0.030 | 0.030 | 0.030 | 0.030 |
| | | Zinc stearate (mass %) | — | — | — | 0.060 | 0.030 | 0.030 | 0.030 | 0.030 |
| | | Magnesium stearate (mass %) | — | — | 0.100 | — | 0.200 | — | 0.200 | 0.100 |
| | Metal dithiocarbamate | ZnDTC (mass %) | — | — | — | — | 0.200 | 0.400 | 0.200 | 0.200 |
| | Acid value improver | Isotridecyl acid phosphate (mass %) | — | 2 | 2 | 2 | 1 | 2 | 2 | 1 |
| Total acid value (mg KOH/g) | | | — | 3.7 | 3.7 | 3.7 | 2.0 | 3.7 | 3.7 | 2.0 |
| Metal stearate/ZnDTC | | | — | — | — | — | 1.38 | 0.19 | 1.38 | 0.88 |
| Metal stearate/isotridecyl acid phosphate | | | — | 0.00 | 0.05 | 0.05 | 0.28 | 0.04 | 0.14 | 0.18 |
| Metal stearate/total acid value | | | — | 0.000 | 0.027 | 0.024 | 0.138 | 0.020 | 0.074 | 0.088 |
| Damage ratio (500,000) | | | 7.4 | 11.7 | 10.3 | 8.3 | 6.3 | 8.3 | 9.7 | 8.0 |

The results are shown together in Table 1, and are graphed and shown in FIG. 1. Examples 1 to 8 include the fatty acid metal salts, the metal dithiocarbamate and the acid value improver, and exhibit greatly improved fretting resistance as compared with Comparative Examples 1 to 4 not containing any one of these additives.

Although Comparative Examples 5 to 8 contain the fatty acid metal salts, the metal dithiocarbamate and the acid value improver and exhibit damage ratios smaller than those of Comparative Examples 1 to 4, the damage ratios are larger than those of Examples 1 to 4. Accordingly, the blending ratio was examined among the fatty acid metal salt, the metal dithiocarbamate and the acid value improver to obtain the following results.

That is, when a ratio of [content of the fatty acid metal salt (mass %)/content of the metal dithiocarbamate (mass %)] is defined as X, and a ratio of [content of the fatty acid metal salt (mass %)/total acid value of the lubricant composition (mgKOH/g)] is defined as Y, all of Examples are within a range indicated by hatching in FIG. 1. In the range indicated by the hatching, X is 0.38 to 1.35, Y is 0.027 or more, and the following relationship (A) is satisfied. In contrast, all of Comparative Examples 5 to 8 are out of the range.

$$Y \leq 0.1547X^2 - 0.1388X + 0.07 \quad \text{(A)}$$

Figure 3:
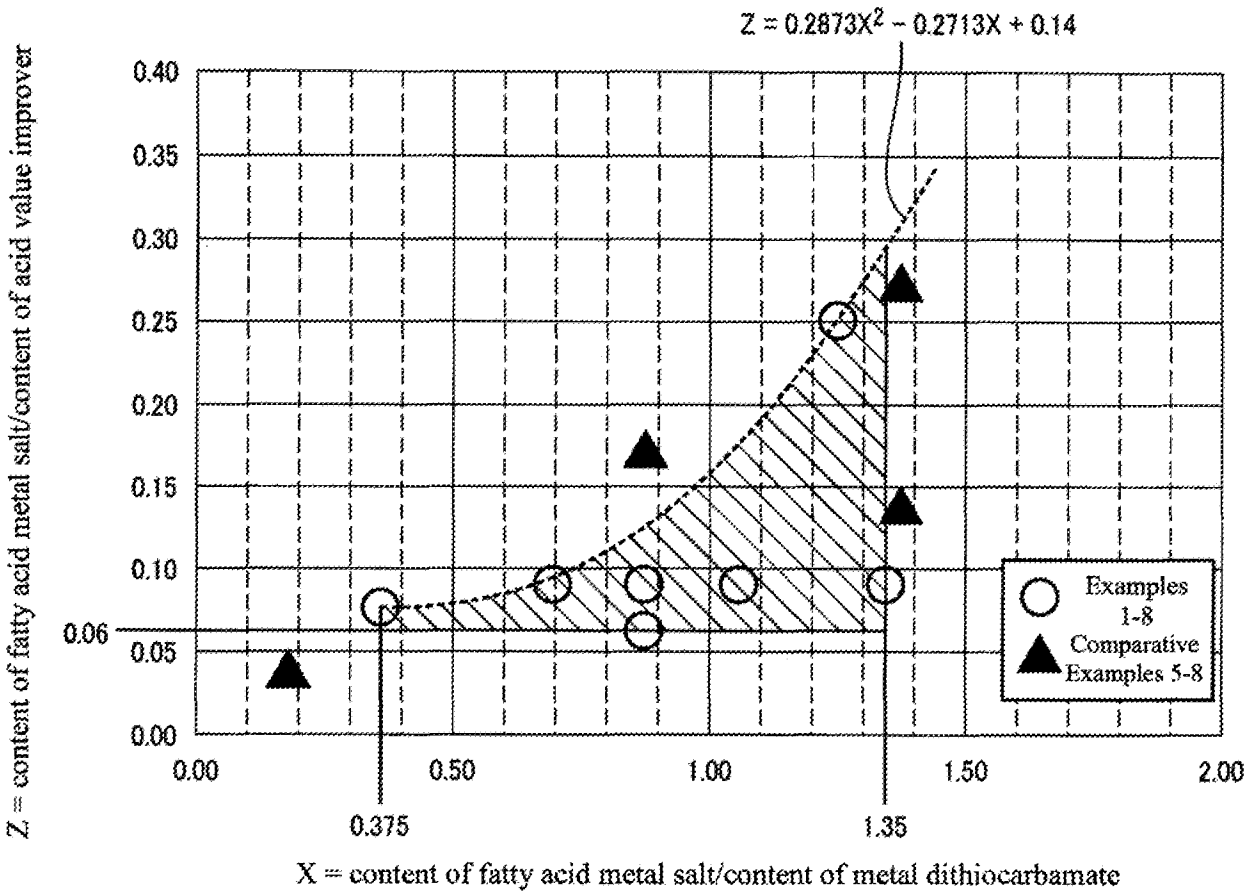
FIG. 3 It is a graph showing a relationship between X, which is [content of the fatty acid metal salt (mass %)/content of the metal dithiocarbamate (mass %)], and Z, which is [content of the fatty acid metal salt (mass %)/content of an acid value improver (mass %)].

In addition, when a ratio of [content of the fatty acid metal salt (mass %)/content of the acid value improver (mass %)] is defined as Z, all of Examples are within the range indicated by hatching in FIG. 3. In the range indicated by the hatching, X is 0.37 to 1.35, Z is 0.06 or more, and the following relationship (B) is satisfied. In contrast, all of Comparative Examples 5 to 8 are out of the range.

$$Z \leq 0.2873X^2 - 0.2713X + 0.14 \quad \text{(B)}$$

Figure 2:
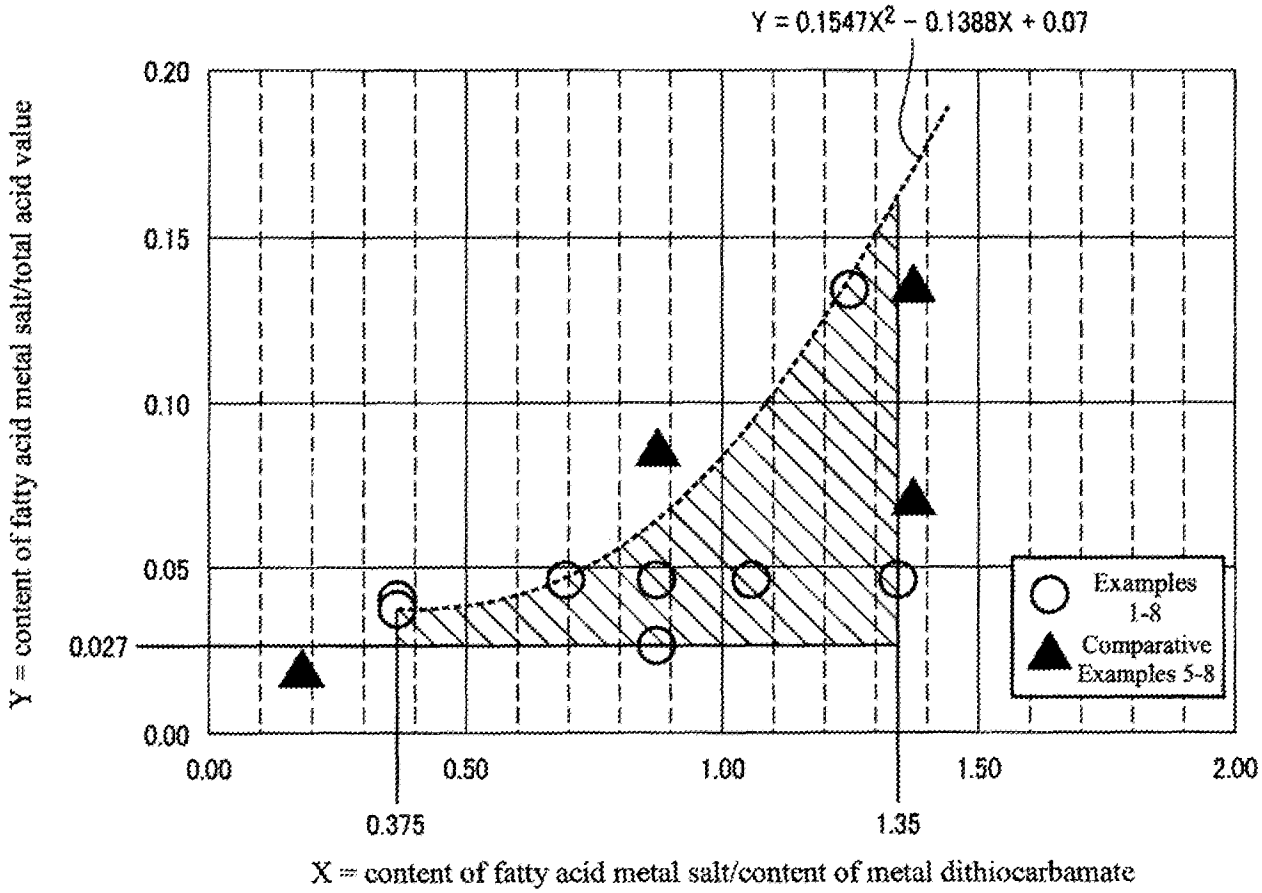
FIG. 2 It is a graph showing a relationship between X, which is [content of a fatty acid metal salt (mass %)/content of a metal dithiocarbamate (mass %)], and Y, which is [content of the fatty acid metal salt (mass %)/total acid value of a lubricant composition (mg KOH/g)].

Therefore, the blending ratio among the fatty acid metal salt, the metal dithiocarbamate and the acid value improver is preferably within the range indicated by the hatching in FIG. 2, and more preferably within the range indicated by the hatching in FIG. 3.

Figure 4:
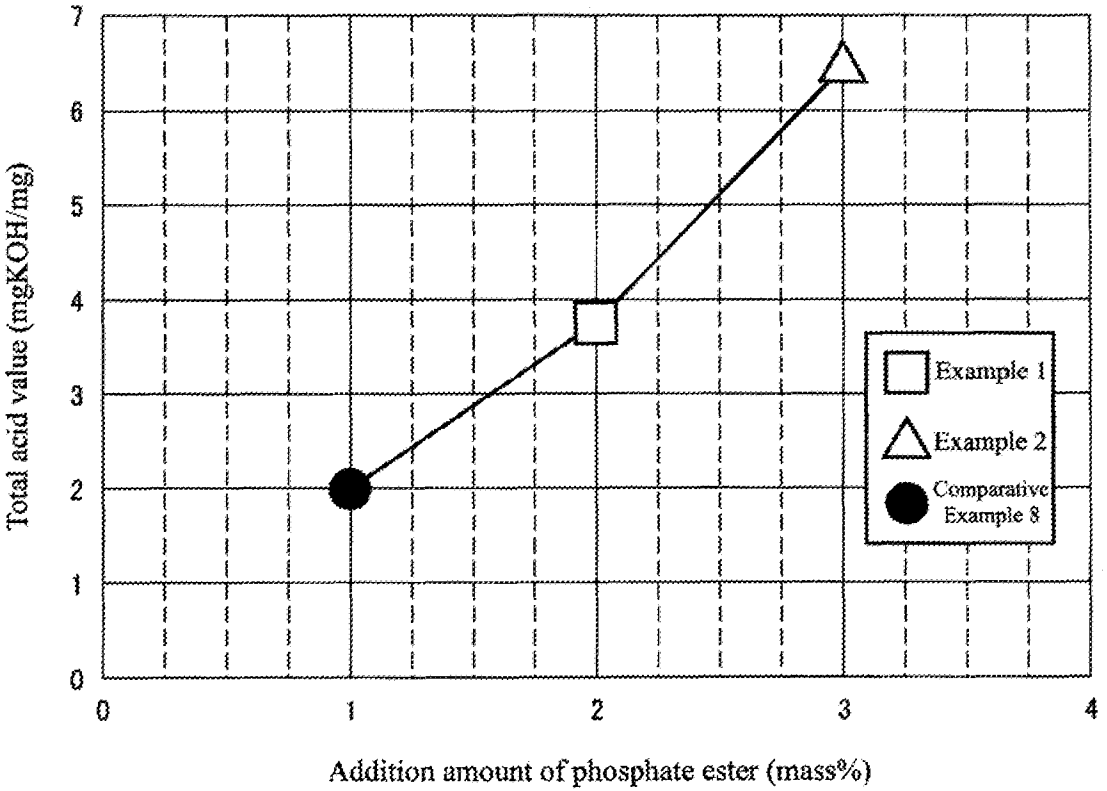
FIG. 4 It is a graph showing a relationship between the addition amount of phosphate ester and the total acid value.
Figure 5:
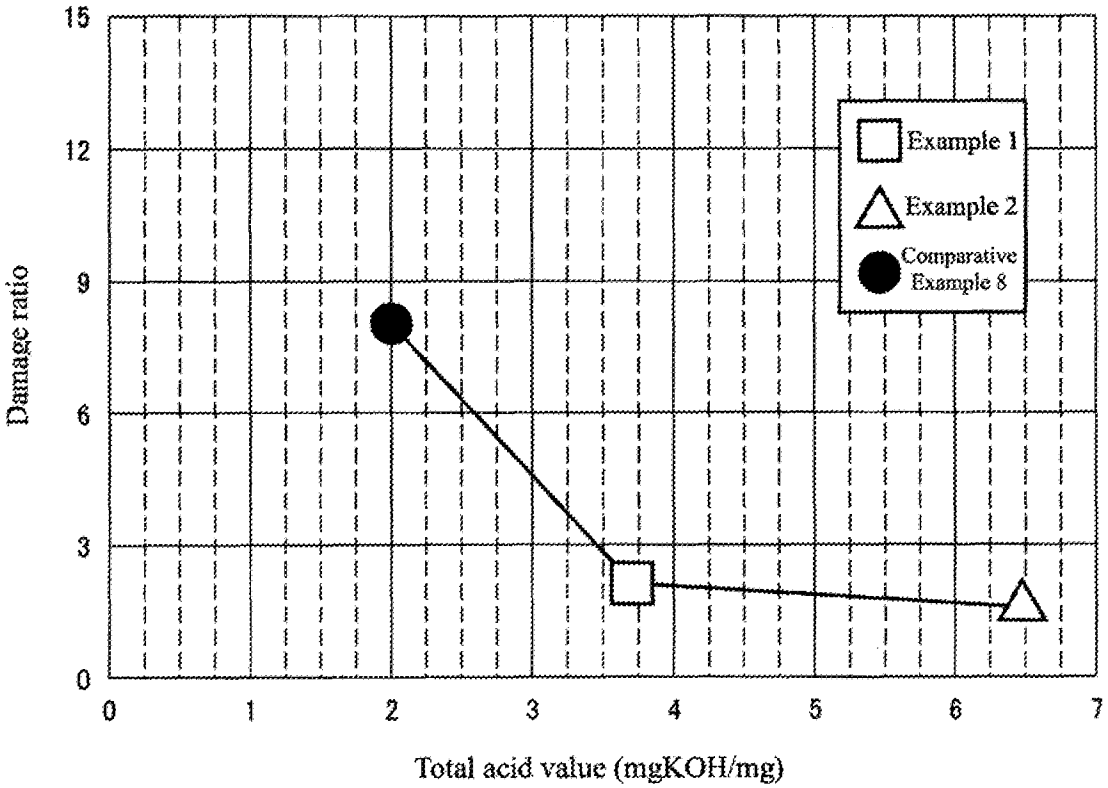
FIG. 5 It is a graph showing a relationship between the total acid value and a damage ratio.

From Examples 1 and 2 and Comparative Example 8, the effect of the combined use of the acid value improver can be verified. In each test greases of Examples 1 and 2 and Comparative Example 8, the contents of the fatty acid metal salts and the metal dithiocarbamate are same, and the contents of the acid value improver are different. As shown in FIG. 4, the total acid values of the test greases increase as the amount of phosphate ester, which is an acid value improver, increases. The relationship between the total acid value and the damage ratio is graphed and shown in FIG. 5. As the total acid value increases, the damage ratio decreases, and a remarkable effect is obtained in the case of a total acid value of 3.7 (mgKOH/g). However, the drop in damage ratio is almost stopped even if the total acid value is more than 3.7 (mgKOH/g). The amount of phosphate ester when total acid value is 3.7 (mgKOH/g) is 2 mass % in FIG. 4, and it can be said that the content of the acid value improver is preferably 2 mass % or more.

Although the invention has been described in detail with reference to specific embodiments, it will be apparent to those skilled in the art that various changes and modifications can be made without departing from the spirit and scope of this disclosure.

This application is based on Japanese Patent Application filed on Dec. 25, 2017 (Japanese Patent Application No. 2017-247911), the contents of which are incorporated herein by reference.

INDUSTRIAL APPLICABILITY

Fretting wear is reduced in a rolling bearing which performs micro reciprocation or undergoes the micro reciprocation, such as a bearing for an AC servo motor, a hub bearing, and a pivot bearing for a hard disk drive (HDD).

The invention claimed is:

1. A grease composition, comprising:

a base oil in which a urea compound is blended as a thickener;

a fatty acid metal salt;

a metal dithiocarbamate; and an acid value improver having an effect of increasing an acid value of the lubricant composition, wherein when a ratio of a content of the fatty acid metal salt (mass %)/content of the metal dithiocarbamate (mass %)]is defined as X, and a ratio of a content of the fatty acid metal salt (mass %)/total acid value of the lubricant composition (mgKOH/g) is defined as Y, X is 0.38 to 1.35, Y is 0.027 or more, and the following relationship (A) is satisfied, $$Y \leq 0.1547X^2 - 0.1388X + 0.07 \quad \text{(A)},$$

wherein the fatty acid metal salt is a salt form of a linear or branched fatty acid and metal, wherein a content of the metal dithiocarbamate is 0.001 to 0.400 mass %, and wherein the metal dithiocarbamate is a compound represented by the following formula (I):

(1)

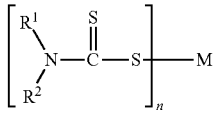

wherein, in Formula (I), M represents Zn; n is an integer corresponding to the valence of the metal; and $R^1$ and $R^2$ independently represent a primary alkyl group, a secondary alkyl group, an aryl group or an alkylaryl group, which have 2 to 18 carbon atoms, wherein the fatty acid metal salt is at least two selected from the group consisting of copper stearate, iron stearate, zinc stearate, and magnesium stearate, and wherein the acid value improver is a phosphate ester, wherein a content of the acid value improver is 1 to 3 mass %, and wherein the phosphate ester is one or more selected from alkyl (C12, C14, C16, or C18) acid phosphate, isotridecyl acid phosphate, oleic acid phosphate, tetracosyl acid phosphate, ethylene glycol acid phosphate, 2-hydroxymethyl methacrylate acid phosphate, dibutyl phosphate, bis(2-ethylhexyl) phosphate, diethyl benzyl phosphate, triphenylphosphine, monoethyl phosphate, mono n-butyl phosphate, mono n-octyl phosphate, mono n-lauryl phosphate, or mono (2-hydroxyethyl methacrylate) phosphate.

2. The grease composition according to claim 1, wherein the total acid value based on JIS K 2501;2003 is 3.7 (mgKOH/g) or more.

3. The grease composition according to claim 1, wherein the fatty acid metal salt includes three or more kinds selected from the group consisting of the copper stearate, iron stearate, zinc stearate, and magnesium stearate.

4. The grease composition according to claim 1, wherein the fatty acid metal salt is a mixture of the copper stearate, iron stearate, zinc stearate, and magnesium stearate.

5. A grease composition, comprising:

a base oil in which a urea compound is blended as a thickener;

a fatty acid metal salt;

a metal dithiocarbamate; and an acid value improver having an effect of increasing an acid value of the lubricant composition, wherein when a ratio of a content of the fatty acid metal salt (mass %)/content of the metal dithiocarbamate (mass %) is defined as X, and a ratio of a content of the fatty acid metal salt (mass %)/total acid value of the lubricant composition (mgKOH/g) is defined as Y, X is 0.38 to 1.35, Y is 0.027 or more, and the following relationship (A) is satisfied, $$Y \leq 0.1547X^2 - 0.1388X + 0.07 \quad \text{(A)},$$

wherein the fatty acid salt includes three or more kinds selected from the group consisting of copper stearate, iron stearate, zinc stearate, and magnesium stearate, wherein a content of the metal dithiocarbamate is 0.001 to 0.400 mass %, and wherein the metal dithiocarbamate is a compound represented by the following formula (I):

(1)

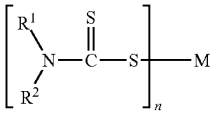

wherein, in Formula (I), M represents Zn; n is an integer corresponding to the valence of the metal; and $R^1$ and $R^2$ independently represent a primary alkyl group, a secondary alkyl group, an aryl group or an alkylaryl group, which have 2 to 18 carbon atoms, and wherein the acid value improver is a phosphate ester, wherein a content of the acid value improver is 1 to 3 mass %, wherein the phosphate ester is one or more selected from alkyl (C12, C14, C16, or C18) acid phosphate, isotridecyl acid phosphate, oleic acid phosphate, tetracosyl acid phosphate, ethylene glycol acid phosphate, 2-hydroxymethyl methacrylate acid phosphate, dibutyl phosphate, bis(2-ethylhexyl) phosphate, diethyl benzyl phosphate, triphenylphosphine, monoethyl phosphate, mono n-butyl phosphate, mono n-octyl phosphate, mono n-lauryl phosphate, or mono (2-hydroxyethyl methacrylate) phosphate wherein a content of the phosphate ester is 2 mass % or higher.

6. The grease composition according to claim 5, wherein the fatty acid metal salt is a mixture of the copper stearate, iron stearate, zinc stearate, and magnesium stearate.

7. The grease composition according to claim 1, wherein a content of the fatty acid metal salt is 0.175 to 0.5 mass %.

8. The grease composition according to claim 5, wherein a content of the fatty acid metal salt is 0.175 to 0.5 mass %.

9. The grease composition according to claim 1, wherein the composition does not include molybdenum dithiocarbamate.

10. The grease composition according to claim 5, wherein the composition does not include molybdenum dithiocarbamate.

* * * * *